US009303567B2

(12) United States Patent
Dickinson

(10) Patent No.: US 9,303,567 B2
(45) Date of Patent: Apr. 5, 2016

(54) THROTTLE BODY WITH OFFSET AXIS DRUM VALVE

(76) Inventor: Dean Dickinson, Norwalk, CA (US)

( * ) Notice: Subject to any disclaimer, the term of this patent is extended or adjusted under 35 U.S.C. 154(b) by 891 days.

(21) Appl. No.: 13/525,667

(22) Filed: Jun. 18, 2012

(65) Prior Publication Data

US 2012/0318234 A1 Dec. 20, 2012

Related U.S. Application Data

(60) Provisional application No. 61/499,045, filed on Jun. 20, 2011.

(51) Int. Cl.

| | |
|---|---|
| ***F02D 9/08*** | (2006.01) |
| ***F02M 9/08*** | (2006.01) |
| ***F02D 9/12*** | (2006.01) |
| *F02D 9/10* | (2006.01) |

(52) U.S. Cl.

CPC .. *F02D 9/08* (2013.01); *F02D 9/12* (2013.01); *F02D 9/1055* (2013.01)

(58) Field of Classification Search

CPC ..... F16K 1/52; F16K 1/06; F16K 1/08; F16K 1/16; F16K 1/20; F16K 1/2014; F16K 1/205; F16K 1/2057; F16K 1/2261; F16K 1/2263; F02D 9/104; F02M 3/07; F02M 3/075

USPC ..... 123/337, 439, 80 C, 81 C, 190.12, 123/190.14; 261/44.7

See application file for complete search history.

(56) References Cited

U.S. PATENT DOCUMENTS

| | | | | | |
|---|---|---|---|---|---|
| 201,699 | A | | 3/1878 | Park | |
| 588,415 | A | | 8/1897 | Foster | |
| 1,166,300 | A | | 12/1915 | Yergens | |
| 1,324,510 | A | * | 12/1919 | McCurdy | 261/51 |
| 1,680,812 | A | | 8/1928 | Sloan | |
| 3,208,719 | A | * | 9/1965 | Hulsey | 251/207 |
| 4,356,801 | A | * | 11/1982 | Graham | 123/337 |
| 4,428,356 | A | * | 1/1984 | Kemmner | 123/585 |
| 4,494,517 | A | | 1/1985 | Kratt et al. | |
| 4,526,729 | A | | 7/1985 | Braun et al. | |
| 4,774,984 | A | * | 10/1988 | Peters | 137/625.32 |
| 4,783,286 | A | | 11/1988 | Lee | |
| 4,909,211 | A | * | 3/1990 | Cook et al. | 123/337 |

(Continued)

FOREIGN PATENT DOCUMENTS

| | | |
|---|---|---|
| JP | 2009-180144 | 8/2009 |

*Primary Examiner* — Mahmoud Gimie

*Assistant Examiner* — David Hamaoui

(74) *Attorney, Agent, or Firm* — Kenneth L. Green; Averill & Green

(57) ABSTRACT

An improved throttle body includes an offset axis drum valve and shaped throat. The offset axis and shaped throat provide gradual initial opening for better throttle control and the drum valve includes a lower face matching the profile of the air path through the throttle body when rotated to a fully open throttle position, providing an optimal flow at full throttle. The offset axis drum further includes a slightly decreasing radius. As the drum opens, the surface of the drum retreats from the throttle body wall providing clearance for dusty environments and reducing tolerances for reduced manufacturing cost. A fuel injector pocket position provides a spray pattern aligned with an initial air flow as the throttle body opens providing better mixing at part throttle. The throttle body further creates a cavity under the drum in the closed position providing an increased volume in the intake tract which improves throttle response.

9 Claims, 9 Drawing Sheets

(56) References Cited

U.S. PATENT DOCUMENTS

| | | | | | |
|---|---|---|---|---|---|
| 5,275,373 | A | * | 1/1994 | Kalippke et al. | 251/208 |
| 5,374,031 | A | * | 12/1994 | Semence et al. | 251/305 |
| 5,803,045 | A | * | 9/1998 | Adamisin et al. | 123/336 |
| 5,947,157 | A | | 9/1999 | Kindersley | |
| 6,047,950 | A | | 4/2000 | Pontoppidan et al. | |
| 6,378,842 | B1 | | 4/2002 | Frese et al. | |
| 6,454,242 | B1 | * | 9/2002 | Garrick et al. | 251/208 |
| 7,185,878 | B2 | * | 3/2007 | Alves | 251/305 |
| 8,171,913 | B2 | * | 5/2012 | Sano | 123/337 |
| 8,616,179 | B2 | * | 12/2013 | Quantz | 123/337 |
| 2006/0102142 | A1 | * | 5/2006 | Holder et al. | 123/308 |
| 2008/0264420 | A1 | | 10/2008 | Brown | |
| 2008/0283016 | A1 | * | 11/2008 | Komiyama et al. | 123/184.56 |

* cited by examiner

THROTTLE BODY WITH OFFSET AXIS DRUM VALVE

The present application claims the priority of U.S. Provisional Patent Application Ser. No. 61/499,045 filed Jun. 20, 2011, which application is incorporated in its entirety herein by reference.

BACKGROUND OF THE INVENTION

The present invention relates to internal combustion engines and in particular to an improved throttle body for Otto cycle engines.

There is a continuing quest to improve the performance of internal combustion engines, both in terms of efficiency and power output. One essential element of internal combustion Otto cycle engines is a throttle body which controls the amount of air entering the engine. Engines produce power by converting chemical energy from reacting (i.e., burning) a mixture of liquid fuel and air into mechanical energy. While only about one third of the chemical energy is converted into mechanical energy, the amount of mechanical energy produced is roughly proportional to the amount of chemical energy released, which in turn is roughly proportional to the amount of air taken into the engine. Because the throttle body limits the amount of air taken into the engine, the throttle body also controls the amount of mechanical energy produced by the engine.

Various throttle bodies are known in the art, these include butterfly type throttle bodies and slide type throttle bodies. Butterfly type throttle bodies are common in many automobiles and are fairly simple, but include a shaft through the center of the throttle body throat which creates some restriction even when fully open. A plate rotated by the shaft to open and close the throttle body also restricts air flow through the throttle body.

Slide type throttle bodies require an extension of the throttle body housing to receive the slide as it opens and may become jammed due to dirt or gavel being captured between the slide and housing in some environments. Further, known butterfly type throttle bodies provide a very non-linear relationship between throttle position and air flow, especially upon initial opening of the throttle. Known fuel injection control units commonly use throttle position as an input and are programmed based on the behavior of the known butterfly type throttle bodies. Other throttle body types, for example, slide type throttle bodies, do not produce a similar non-linear relationship between throttle position and air flow, and difficulties arise when another throttle body type is substituted for a butterfly type throttle body. Unfortunately, the known fuel injection control units often allow only a narrow adjustment which is not adequate when another throttle body type is substituted for a butterfly type throttle body.

BRIEF SUMMARY OF THE INVENTION

The present invention addresses the above and other needs by providing an improved throttle body including an offset axis drum valve and shaped throat. The offset axis and shaped throat provide gradual initial opening for better throttle control and the drum valve includes a lower face matching the profile of the air path through the throttle body when rotated to a fully open throttle position, providing an optimal flow at full throttle. The offset axis drum further includes a slightly decreasing radius. As the drum opens, the surface of the drum retreats from the throttle body wall providing clearance for dusty environments and reducing tolerances for reduced manufacturing cost. A fuel injector pocket position provides a spray pattern aligned with an initial air flow as the throttle body opens providing better mixing at part throttle. The throttle body further creates a cavity under the drum in the closed position providing an increased volume in the intake tract which improves throttle response.

In accordance with one aspect of the invention, there is provided a throttle body having an offset axis drum valve. The offset axis drum valve provides a more gradual initial opening for better throttle control.

In accordance with another aspect of the invention, there is provided a throttle body having a drum valve which includes a lower face matching the profile of the air path through the throttle body providing an optimal air flow at fully open throttle.

In accordance with still another aspect of the invention, there is provided a throttle body having a drum with a slightly decreasing radius. As the drum opens, the surface of the drum retreats from the throttle body wall providing clearance for dusty environments and reducing tolerances for reduced manufacturing cost.

In accordance with one yet another aspect of the invention, there is provided a throttle body providing an initial air flow directed toward a fuel injector spray pattern. A trailing edge of the drum meets the throttle body throat wall above the injector spray pattern. At initial and partial throttle opening, the air flow is concentrated on the fuel injector spray pattern providing better fuel/air mixing and more efficient combustion.

In accordance with still another aspect of the invention, there is provided a throttle body having a drum cavity providing an increased volume below the drum at closed throttle. As the throttle opens the drum rotates into the cavity. As the throttle is closed, the cavity adds volume to the intake path improving the volumetric efficiency of the motor.

In accordance with another aspect of the invention, there is provided a throttle body having a shaped throat contoured to reduce the area provided for air flow at partial throttle opening. Butterfly throttles are known to provide a desirable throttle opening response. Other known designs, for example slide throttles, generally open to quickly or suffer from poor response at partial throttle. The shaped throat may be shaped to provide a more gradual opening of the air passage.

In accordance with still another aspect of the invention, there is provided a throttle body having a shaped throat is contoured to direct air flow towards an injector spray pattern. The shaped throat opens a small area directly above the injector spray pattern. Initial tests have shown increased power for the same air and fuel flow, indicating that more efficient combustion is taking place.

In accordance with another aspect of the invention, there is provided a throttle body having a shaped throat providing an air flow very close to the air flow of a butterfly type throttle body at initial throttle opening. Nearly all motorcycles fuel injection systems use throttle position as a fuel management input. The shaped throat closely duplicates the butterfly throttle body air flow, thus allowing retention of the original fuel injection system.

In accordance with yet another aspect of the invention, there is provided a slide throttle body having shaped throats. At initial opening, the air flow is reduced to be more like a butterfly throttle, and the air flow is directed towards the injector spray pattern to improve part throttle combustion.

In accordance with another aspect of the invention, there is provided a slide throttle body having shaped slide plate passages. The known slide plate is replaced by a slide plate with an extended narrowed opening aligned with fuel injector nozzles. At initial opening, the air flow is reduced to be more like a butterfly throttle, and the air flow is directed towards the injector spray pattern to improve part throttle combustion.

In accordance with still another aspect of the invention, there is provided a method for matching the initial throttle opening air flow of a shaped throttle body to a butterfly type throttle body. The method includes constructing a shaped throttle body with additional material in the throttle body throat blocking air flow at initial throttle opening, measuring the air flow of an original throttle body at a minimum 1st throttle opening, opening the shaped throttle body to the 1st throttle opening position, removing some of the additional material from the throat of the shaped throttle body to match the air flow of the original throttle body at the 1st throttle opening position, measuring the air flow of an original throttle body at a slightly greater 2nd throttle opening position, opening the shaped throttle body to the same 2nd throttle opening position, removing some of the additional material from the throat of the shaped throttle body to match the air flow of the original throttle body at the 2nd throttle opening position, and repeating the previous three steps for several greater throttle opening positions. The flow through the shaped throttle body is measured at each throttle position as material is removed incrementally. Material is preferably removed near the center of the throttle opening to direct the air flow towards a fuel injector spray pattern below the throttle opening, and the additional material removed at each step is selected to avoid affecting the air flow at smaller throttle opening positions.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
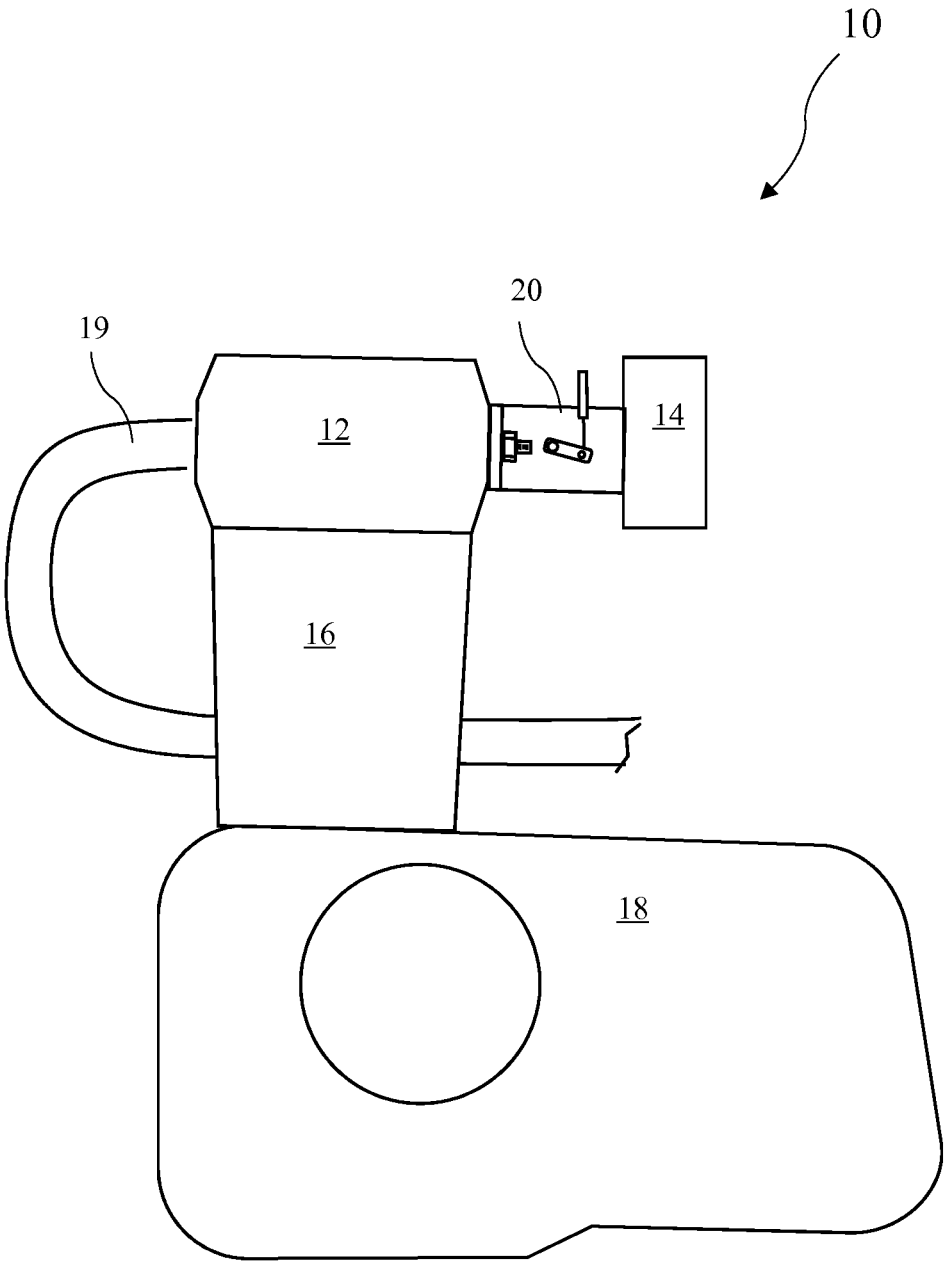
FIG. 1 is a compact "V" engine.

A side view of a motorcycle engine 10 is shown in FIG. 1. The motorcycle engine 10 includes cylinder head 12, cylinder 16, block 18, air cleaner 14, exhaust pipes, 19, and throttle body 20. The throttle body 20 controls the amount of air entering the engine 10 and thereby the amount of power produced by the engine 10.

Figure 2A:
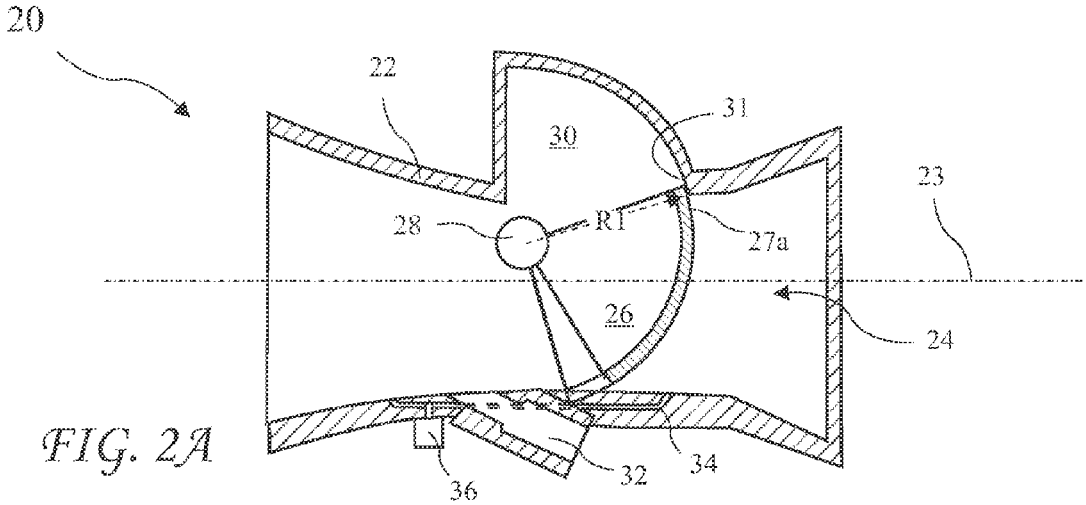
FIG. 2A is a cross-sectional view of a throttle body according to the present invention in a closed position.
Figure 2B:
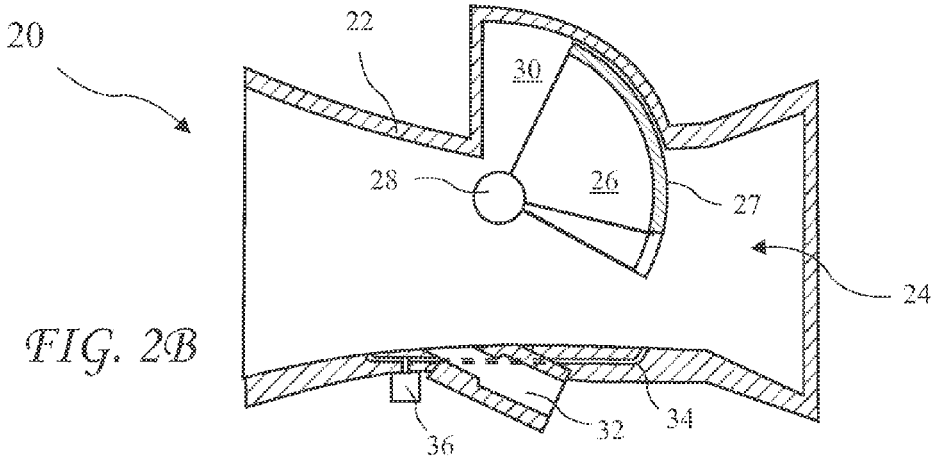
FIG. 2B is a cross-sectional view of the throttle body according to the present invention in a partially open position.
Figure 2C:
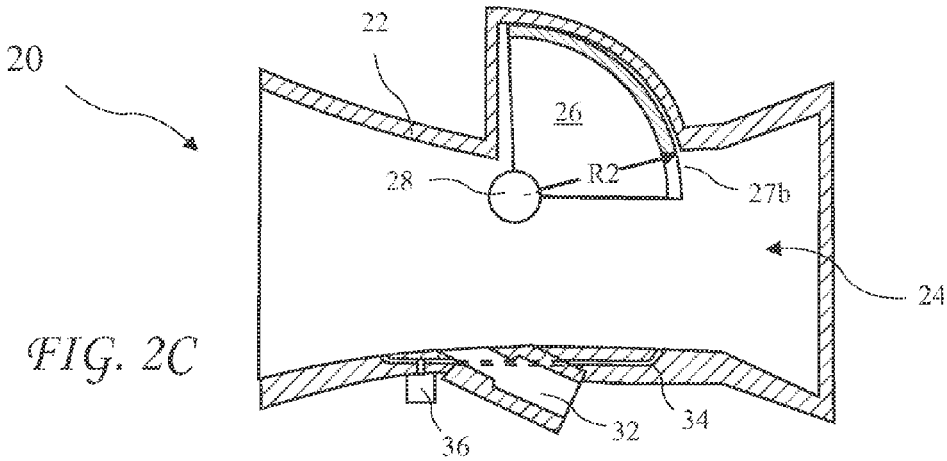
FIG. 2C is a cross-sectional view of the throttle body according to the present invention in a fully open position.

A cross-sectional view of a throttle body 20 according to the present invention in a closed position is shown in FIG. 2A, a cross-sectional view of the throttle body 20 in a partially open position is shown in FIG. 2B, and a cross-sectional view of the throttle body 20 in a fully open position is shown in FIG. 2C. The throttle body 20 includes a housing 22 providing an air path 24 into the engine 10. A drum valve 26 rotates on an offset axis 28 into and out of a drum cavity 30 to open and close the throttle body 20, moving proximal to a cavity lip 31. The axis 28 is offset from the centerline of the air path 24. The offset axis drum valve 26 provides gradual initial opening for better throttle control.

In the closed position, the cavity 30 is created inside the housing 22 and under the drum valve 26 when the drum is in a closed and partially closed position. Some engine builders have found that increasing the volume under the throttle body, improves engine performance.

The face (or upper surface) 27 of the drum valve 26 has a first radius R1 along a leading edge 27*a* and a second radius R2 at a trailing edge 27*b*. The radius R2 is slightly smaller than the radius R1 to allow a close fit between the leading edge 27*a* and the interior of the housing 22 to seal the air path 24 through the throttle body when an idle air passage 34 and idle control valve 36 are present to control idle, and to facilitate fine adjustment of idle when the drum valve 26 is adjusted to control the idle. The increasing clearance between the drum valve 26 and the housing 22 as the throttle is opened helps reduce the potential for dust and the like to jam the drum valve 26 when a motorcycle is operated in a dusty environment.

An injector pocket 32 is positioned in the housing under the initial opening of the drum valve 26. As a result, a part throttle air flow through the housing will intersect fuel sprayed by a fuel injector to provide better mixing at part throttle.

Figure 3B:
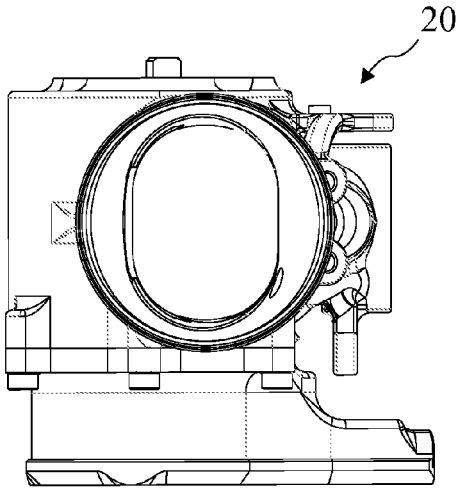
FIG. 3B is a top view of the first embodiment of the throttle body according to the present invention.
Figure 3C:
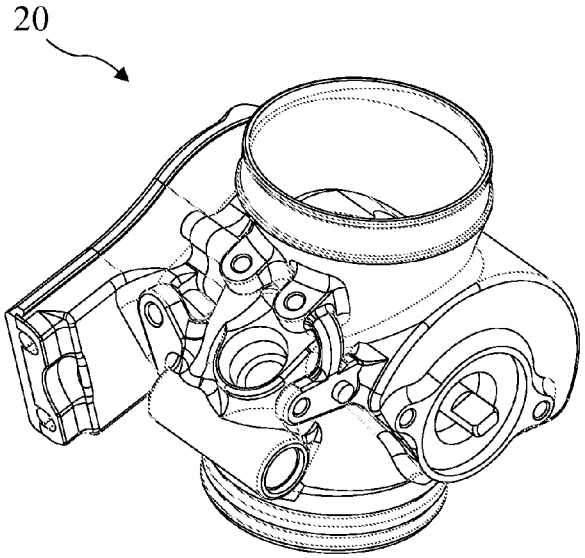
FIG. 3C is a first perspective view of the first embodiment of the throttle body according to the present invention.
Figure 3A:
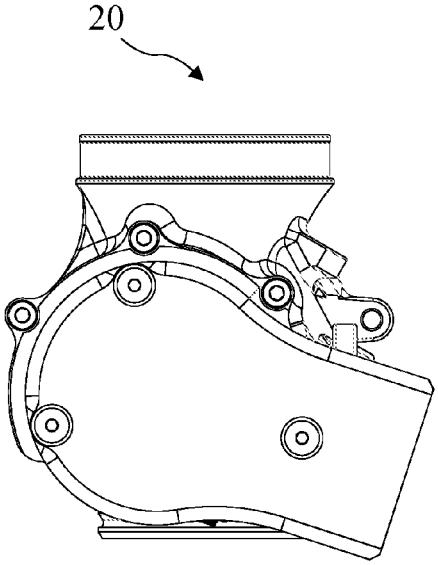
FIG. 3A is a side view of a first embodiment of the throttle body according to the present invention.
Figure 3D:
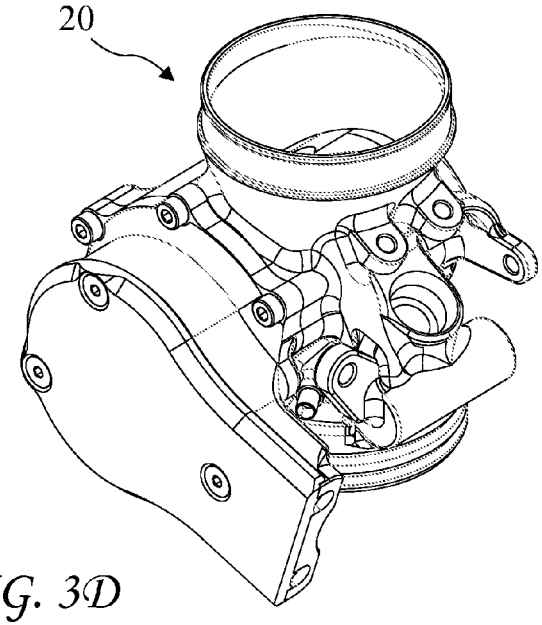
FIG. 3D is a second perspective view of the first embodiment of the throttle body according to the present invention.
Figure 4:
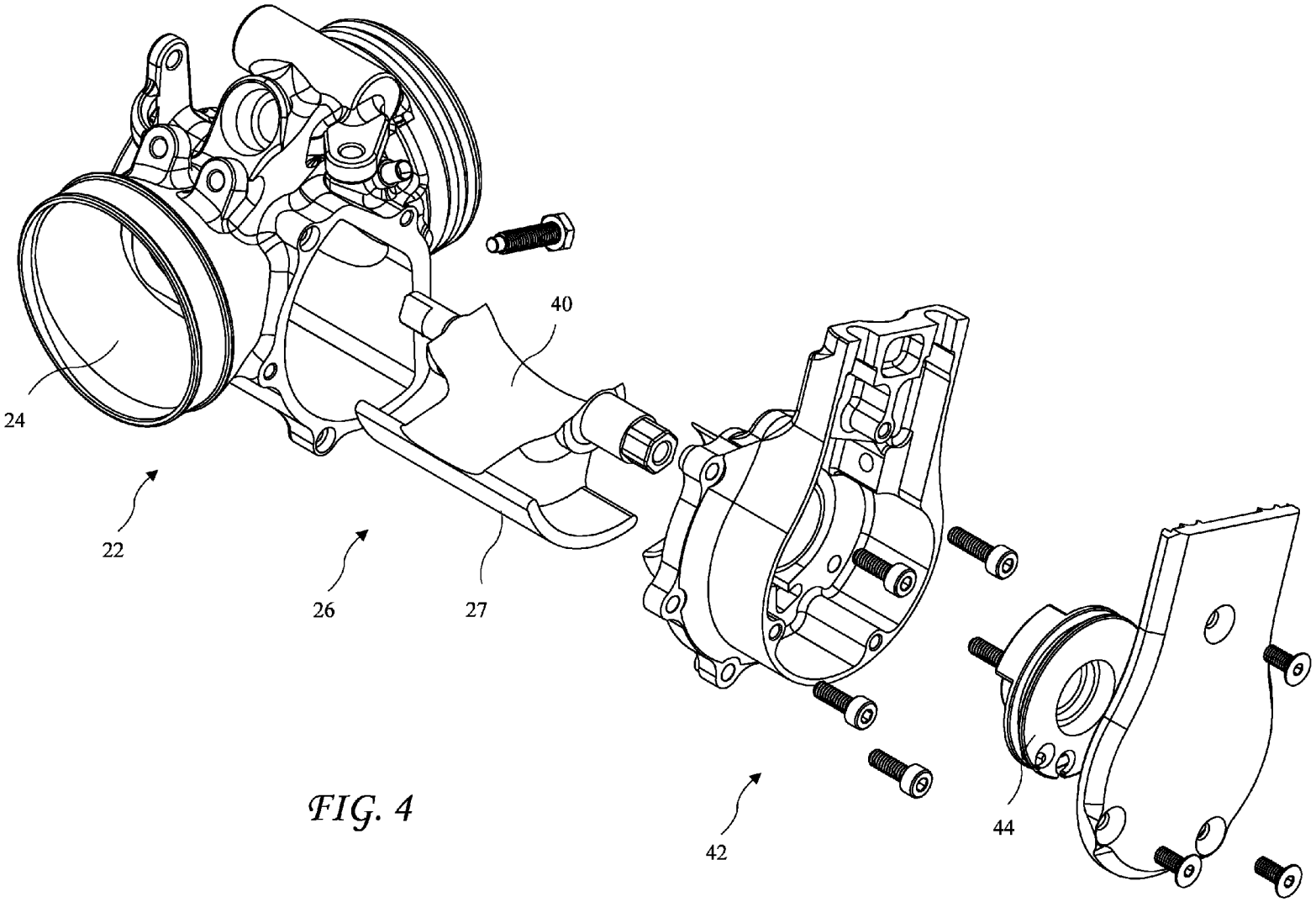
FIG. 4 is an exploded view of the first embodiment of the throttle body according to the present invention.

A side view of a first embodiment of the throttle body 20 according to the present invention is shown in FIG. 3A, a top view of the throttle body 20 is shown in FIG. 3B, a first perspective view of the throttle body 20 is shown in FIG. 3C, a second perspective view of the throttle body 20 is shown in FIG. 3D, and an exploded view of the throttle body 20 is shown in FIG. 4. The drum valve 26 is seen to have a concave vertical face 40 which blends with air path 24 through the housing 22 at fully open throttle. A throttle cable housing 42 attached to the side of the housing 22 and contains a cable drum 44 to which a throttle cable may be attached to operate the throttle body 20.

Figure 7B:
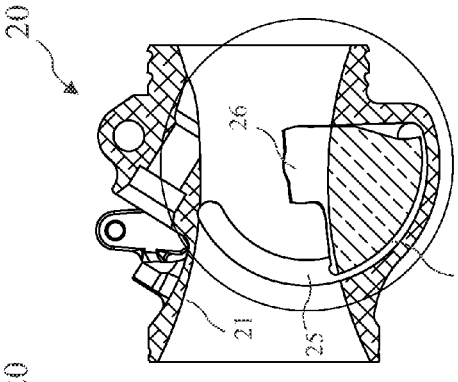
FIG. 7B shows a cross-sectional view of the throttle body with the drum valve fully open taken along line 7B-7B of FIG. 7A.
Figure 7A:
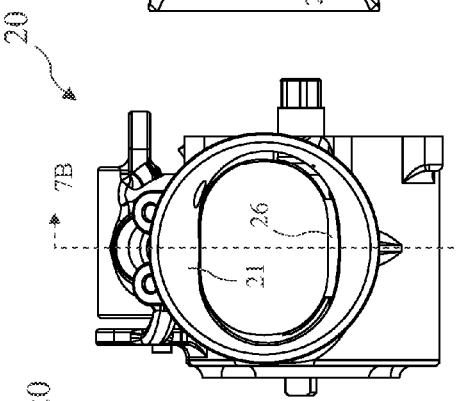
FIG. 7A shows the throttle body with the drum valve fully open.
Figure 6B:
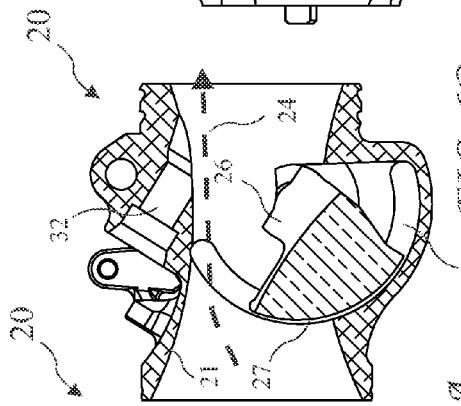
FIG. 6B shows a cross-sectional view of the throttle body with the drum valve partially open taken along line 6B-6B of FIG. 6A.
Figure 6A:
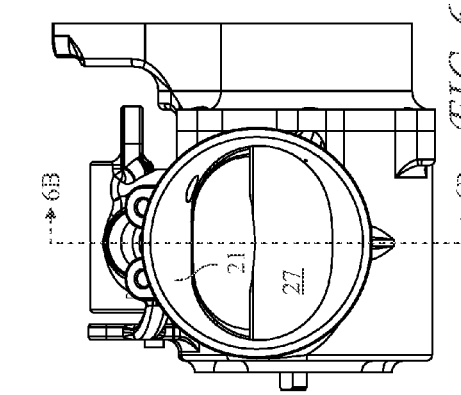
FIG. 6A shows the throttle body with the drum valve partially open.
Figure 5B:
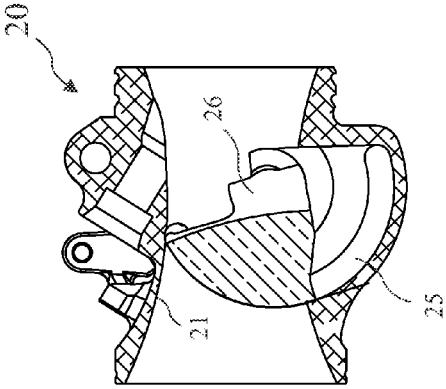
FIG. 5B shows a cross-sectional view of the throttle body with the drum valve fully closed taken along line 5B-5B of FIG. 5A.
Figure 5A:
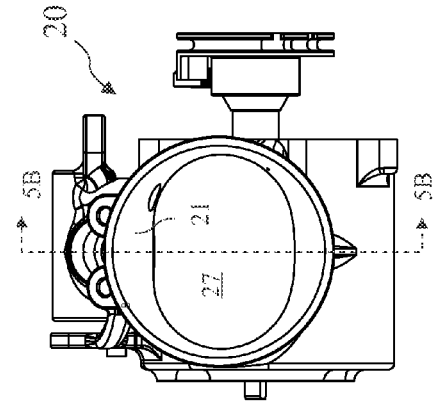
FIG. 5A shows the throttle body with the drum valve fully closed.

The throttle body 20 with the drum valve 26 is shown fully closed in FIG. 5A and a cross-sectional view of the throttle body 20 with the drum valve 26 fully closed taken along line 5B-5B of FIG. 5A is shown in FIG. 5B. The throttle body 20 with the drum valve 26 is shown partially open in FIG. 6A and a cross-sectional view of the throttle body 20 with the drum valve 26 partially open taken along line 6B-6B of FIG. 6A is shown in FIG. 6B. The throttle body 20 with the drum valve 26 is shown fully open in FIG. 7A and a cross-sectional view of the throttle body 20 with the drum valve 26 fully open taken along line 7B-7B of FIG. 7A is shown in FIG. 7B. A curved concave rear face 27' of the drum valve 26 extending down from the trailing edge 27*b* of the face 27 is seen to blend into the throat 21 of the throttle body 20 in the fully open position providing a smooth passage for air entering the engine 10. The drum valve 26 is seen in FIG. 6B to allow part throttle air flow along a side of the air path 24 passing over the injector pocket 32. Drum valve wings 26*a* and 26*b* (see FIG. 8) rotate through drum valve slots 25 in the interior of the throttle body 20 as the drum valve opens and closes.

Figure 8:
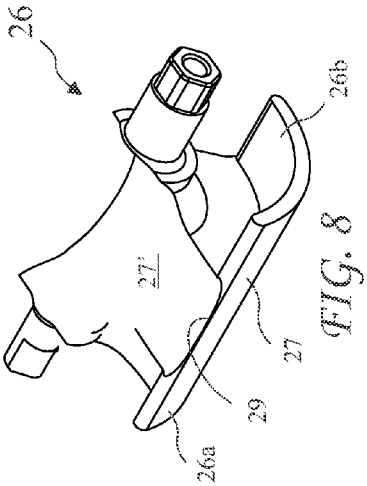
FIG. 8 shows a perspective view of the drum valve according to the present invention.

A perspective view of the drum valve 26 according to the present invention is shown in FIG. 8 showing drum valve wings 26*a* and 26*b* on opposite sides of the face 27. The drum valve wings 26*a* and 26*b* rotate through the drum valve slots 25 (see FIGS. 5B, 6B, and 7B). The wings 26*a* and 26*b* defining parallel spaced apart arcs. A recess 29 in the trailing edge 27*b* of the drum valve face 27 cooperates with the shaped throat 58 to provide openings 54*a* and 54*b* (see FIG. 10B).

Figure 9B:
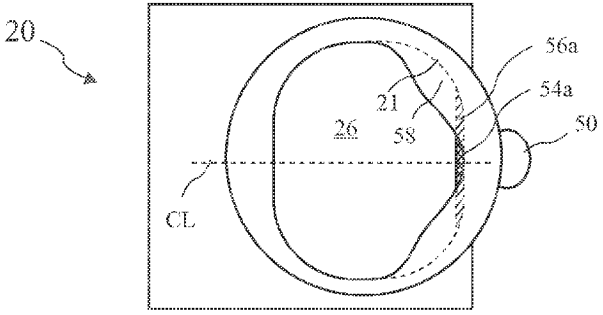
FIG. 9B shows a top view of the throttle body with the shaped throat for limiting and/or directing air flow at the partial throttle opening according to the present invention.
Figure 9A:
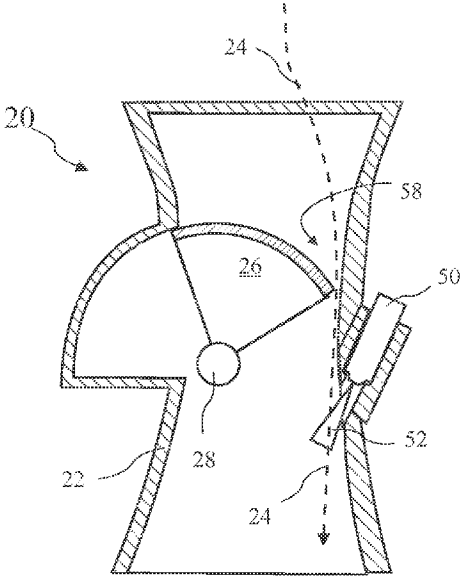
FIG. 9A shows a cross-sectional view of the throttle body with a shaped throat for limiting and/or directing air flow at partial throttle opening according to the present invention.
Figure 10B:
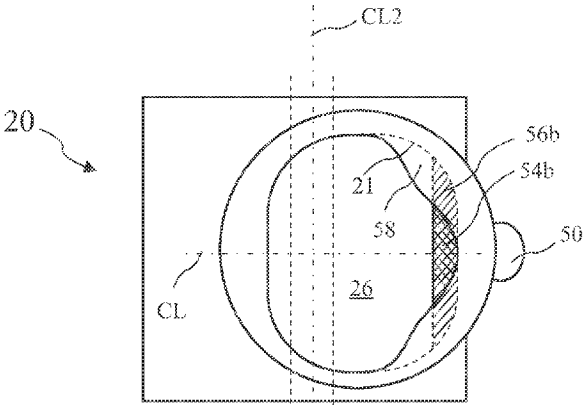
FIG. 10B shows a top view of the throttle body with the shaped throat for limiting and/or directing air flow at the second partial throttle opening according to the present invention.
Figure 10A:
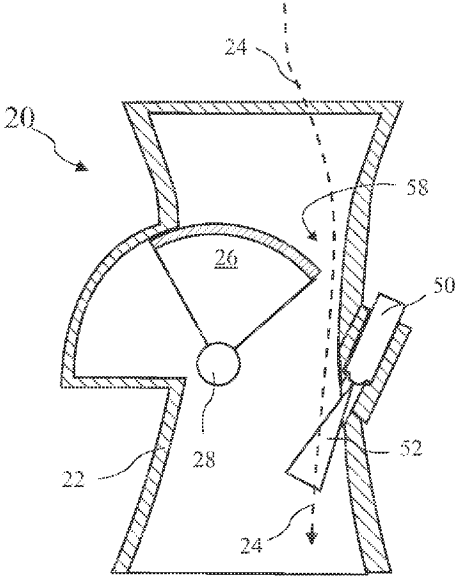
FIG. 10A shows a cross-sectional view of the throttle body with a shaped throat for limiting and/or directing air flow at a second partial throttle opening according to the present invention.

A cross-sectional side view of the throttle body 20 with a shaped throat 58 for limiting and/or directing air flow at partial throttle opening according to the present invention is shown in FIG. 9A, a top view of the throttle body 20 with the shaped throat 58 for limiting and/or directing air flow at the partial throttle opening is shown in FIG. 9B, a cross-sectional view of the throttle body 20 with the shaped throat 58 for limiting and/or directing air flow at a second partial throttle opening is shown in FIG. 10A, and a top view of the throttle body 20 with the shaped throat 58 for limiting and/or directing air flow at the second partial throttle opening is shown in FIG. 10B. The shaped throat 58 is contoured to reduce the areas 56*a* and 56*b* at partial throttle opening providing a response preferred by most motorcycle riders, and similar to the response provided by butterfly type throttle bodies. Further, the initial opening of the drum valve 26 provides a narrow "squeeze" opening aligned with the fuel injector 50. The air flow 24 is thus directed towards the fuel spray 52 from the injector 50. Tests performed have shown an increase in power, compared to a butterfly type throttle body, at an identical air and fuel flow, indicating improved combustion. The drum valve 26 and shaped throat 58 generally share a centerline CL generally perpendicular to a centerline CL2 of the offset axles 28 of the drum valve 26. An horizontal projection 28' of the offset axles 28 passes thorough the throttle body throat 58, and a center portion of the horizontal projection 28 is completely surrounded by the throat 58.

The unshaped throat 21 is shown as a dashed line. The shaped throat 58 provides reduced openings 54*a* and 54*b* (shown with double cross hatch shading) generally centered on the centerline CL, and unshaped throat 21 provides the larger and wider additional openings 56*a* and 56*b* (shown with single cross hatch shading). The openings 54*a* and 54*b* are both smaller and narrower than the openings created by the throat 21 at the same throttle position, providing the desired throttle response and directing the air flow to the fuel spray 52.

The shaped throat 58 is formed by narrowing the throat at the area of initial opening and/or above the injector 50. The narrowing may take the form of a rounded "V" shape. Nearly all motorcycles fuel injection systems use throttle position as a fuel management input. The shaped throat 58 closely matches butterfly throttle body air flow at small throttle opening, thus allowing retention of the original fuel injection system on motors designed for butterfly throttle bodies. Although some fuel injection systems allow editing parameters, there are often small limits on such editing, and the software does not allow changes to accommodate changing an original butterfly type throttle body to a different style throttle body.

Alternatively, the drum valve 26 may have a shaped trailing edge having an indentation at the center, thus providing a reduced air flow at initial opening and directing the air flow towards the fuel spray 52.

Figure 11B:
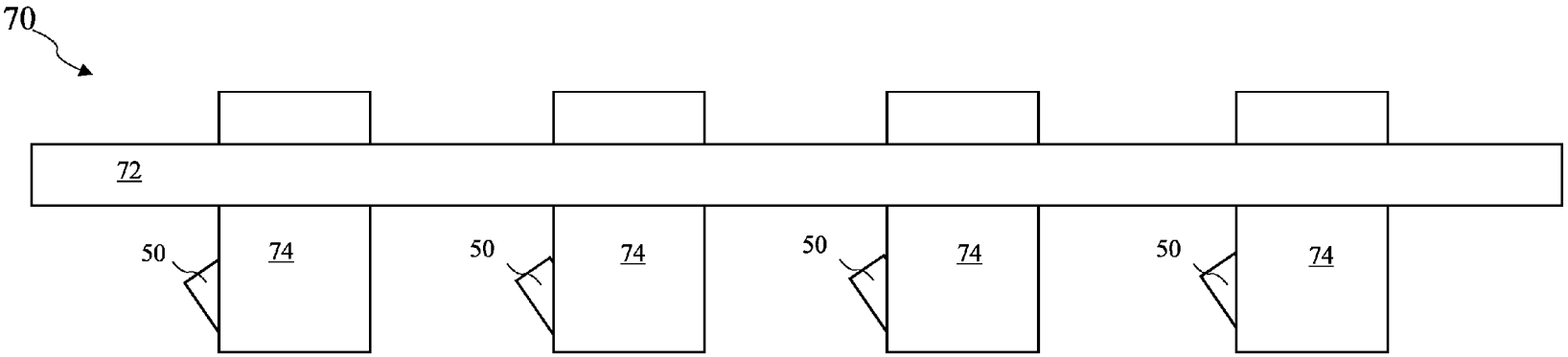
FIG. 11B shows a side view of a slide plate throttle according to the present invention.
Figure 11A:
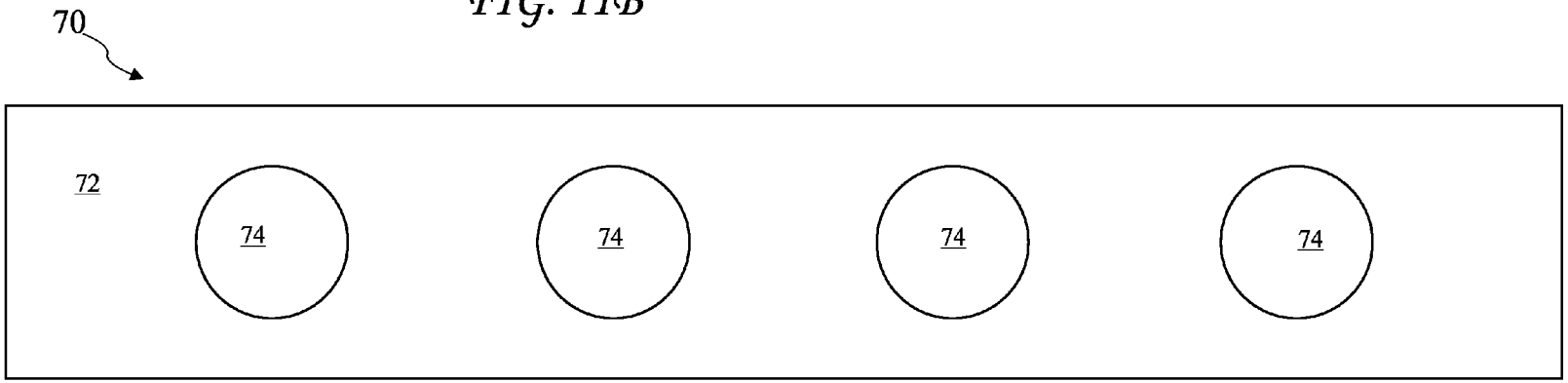
FIG. 11A shows a top view of a slide plate throttle according to the present invention.

A top view of a four throat slide plate throttle 70 according to the present invention is shown in FIG. 11A and a side view of the slide plate throttle 70 is shown in FIG. 11B. The slide plate throttle 70 includes four runners 74 in fluid communication with a cylinder head, and preferably one runner 74 in fluid communication with each cylinder of a motor, which motor may be a one or more cylinder motor. A slide plate assembly 72 cooperates with each of the runners 74 to control air flow through the slide plate throttle 70, and an injector 50 provides fuel to each runner 74.

Figure 13:
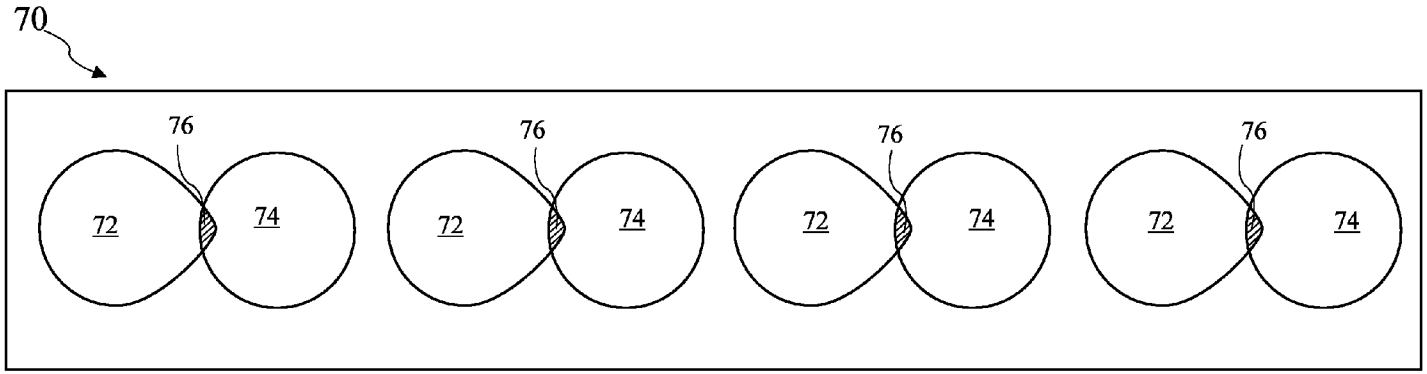
FIG. 13 shows the overlap of a partially open slide plate throttle according to the present invention.
Figure 12:
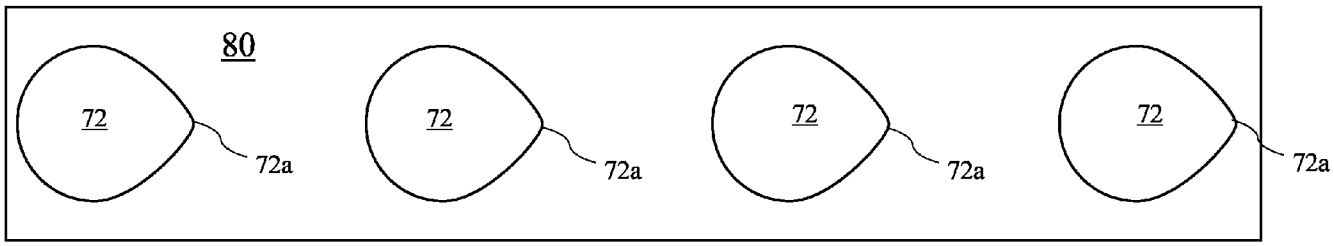
FIG. 12 shows a top view of a shaped slide plate according to the present invention.
Figure 15:
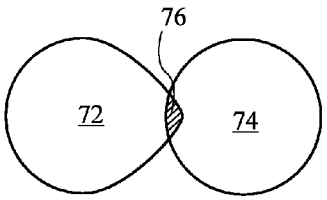
FIG. 15 shows the overlap of one throat of the shaped slide plate according to the present invention.
Figure 14:
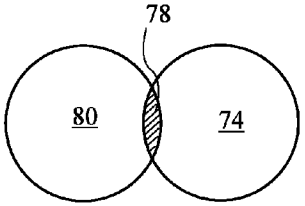
FIG. 14 (prior art)
FIG. 14 shows the overlap of a prior art slide plate.

A top view of a shaped slide plate 80 according to the present invention, residing in the slide plate assembly 72, is shown in FIG. 12 and the partial throttle overlap 76 of the slide plate 80 with the runners 74 is shown in FIG. 13. The shaped slide plate 80 slides in the slide plate assembly 72 to open and close the slide plate throttle 70. The shaped slide plate 80 includes shaped passages 72 having a narrowed leading edge 72*a*. The overlap 78 of a prior art slide plate throttle is shown in FIG. 14, and the overlap 76 of one throat 74 of the shaped slide plate is shown in FIG. 15. During initial opening of the slide plate throttle 70, the narrowed leading edge 72*a* attenuates the throttle response and directs the air flow towards the injector 50, thus providing the desired throttle response and improved combustion efficiency at partial throttle.

Figure 16:
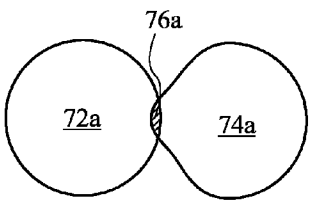
FIG. 16 shows the overlap of one throat of an un-shaped slide plate with a shaped runner according to the present invention.

While the slide plate throttle 70 is shown having four runners in line, when space between the runners must be reduced, the runners may be offset. Further, the slide plate throttle may comprise round passages 72*a*, and the runners may be shaped runners 74*a* in the same manner as the shaped throat 58 at the area of initial opening 76*a* to reduce initial air flow and direct the air flow towards the injectors as shown in FIG. 16.

Figure 17:
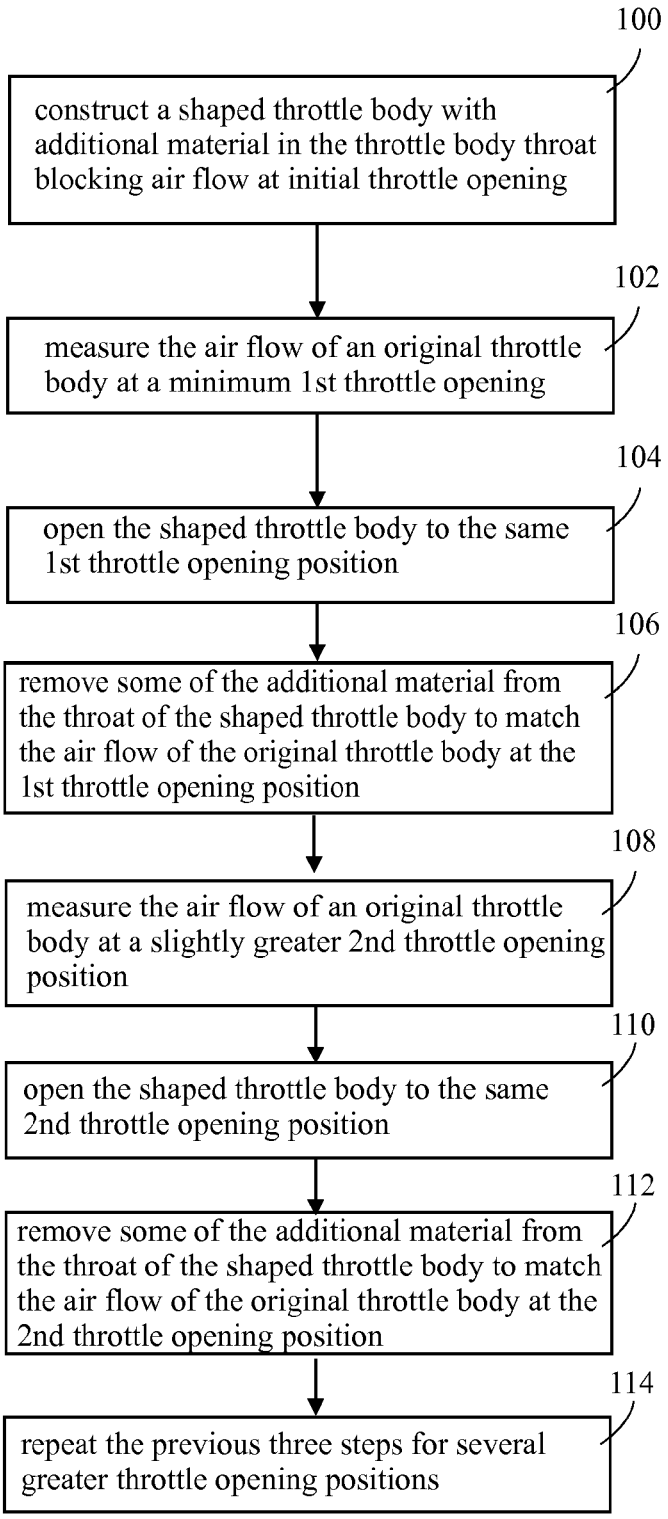
FIG. 17 is a method for matching the initial throttle opening air flow of a shaped throttle body to a butterfly type throttle body according to the present invention.

A method for matching the initial throttle opening air flow of a shaped throttle body to a butterfly type throttle body according to the present invention is shown in FIG. 17. The method includes constructing a shaped throttle body with additional material in the throttle body throat blocking air flow at initial throttle opening at step 100; measuring the air flow of an original throttle body at a minimum 1st throttle opening position at step 102; opening the shaped throttle body to the same 1st throttle opening position at step 104; removing some of the additional material from the throat of the shaped throttle body to match the air flow of the original throttle body at the 1st throttle opening at step 106; measuring the air flow of an original throttle body at a slightly greater 2nd throttle opening position at step 108; opening the shaped throttle body to the same 2nd throttle position at step 110; removing some of the additional material from the throat of the shaped throttle body to match the air flow of the original throttle body at the 2nd throttle opening position at step 112; and repeating steps 108, 110 and 112 for several greater throttle opening positions. The flow through the shaped throttle body is measured at each throttle opening position as material is removed incrementally. Material is preferably removed near the center of the throttle opening to direct the air flow towards a fuel injector spray pattern below the throttle opening, and the additional material removed at each step is selected to avoid affecting the air flow at smaller throttle opening positions.

While the invention herein disclosed has been described by means of specific embodiments and applications thereof, numerous modifications and variations could be made thereto by those skilled in the art without departing from the scope of the invention set forth in the claims.

I claim:

1. A throttle body comprising:

a throttle body throat for passing a flow of air to an engine;

a drum valve rotating about a drum valve axis defined by drum valve axles offset to a side of the throttle body throat and intersecting the throttle body throat and having a range of positions between a fully closed position and a fully open position;

a centerline CL of the drum valve perpendicular to the drum valve axis;

a face of the drum valve facing outward towards the flow of air into the throttle body throat;

a leading edge of the drum valve face;

a trailing edge of the drum valve face opposite to the leading edge, the face defined between the leading edge and the trailing edge;

a drum valve cavity formed in the throttle body throat, the drum valve rotating open rotating the leading edge first into the drum valve cavity, the leading edge moving during opening in a same general direction as the air flow through the throttle body throat;

the throttle body throat having narrowed walls on opposite sides of the drum valve centerline CL cooperating with the drum valve at initial opening of the drum valve to provide narrowed and reduced air flow through the throttle body throat at initial opening of the throttle; and a fuel injector pocket below the area of initially opening of the throttle and centered below the narrowed walls, wherein the drum valve face defines a curved generally rectangular surface having wings on opposite sides, the wings define parallel spaced apart arcs, and the throttle body throat includes opposing curved slots configured to receive the wings.

2. The throttle body of claim 1, wherein:

the drum valve face defines a decreasing drum valve radius, decreasing from the leading edge of the face to the trailing edge of the face; and the drum valve face retreating from a cavity lip of the drum valve cavity as the drum valve is rotated into the drum valve cavity, providing clearance for dusty environments and reducing tolerances for reduced manufacturing cost.

3. The throttle body of claim 1, wherein the drum valve includes a curved concave lower face matching the profile of the throat when the drum valve is rotated to a fully open throttle position for providing an optimal flow at full throttle.

4. The throttle body of claim 3, wherein the drum valve axles comprises two spaced apart axle portions offset to a side of the throttle body throat and separated by the curved concave lower face.

5. The throttle body of claim 4, wherein the drum valve axles defines an axle centerline CL2 passing through the throttle body throat.

6. The throttle body of claim 4, wherein a horizontal projection of the drum valve axles passes thorough the throttle body throat, and a center portion of the horizontal projection of the drum valve axles is completely surrounded by the throttle body throat.

7. The throttle body of claim 3, wherein:

the drum valve axles comprises two spaced apart axle portions offset to a side of the throttle body throat and separated by a gap; and a horizontal projection of the drum valve axles passes thorough the throttle body throat, and a center portion of the horizontal projection of the drum valve axles is completely surrounded by the throttle body throat.

8. The throttle body of claim 3, wherein:

the drum valve axles comprises two spaced apart axle portions separated by a gap; and a horizontal projection of the drum valve axles passes thorough the throttle body throat, and a center portion of the horizontal projection of the drum valve axles resides completely in the throttle body throat.

9. The throttle body of claim 1, wherein the trailing edge of the drum valve face includes a recessed center portion aligned with the narrowed walls of the throttle body throat.

* * * * *